US009955824B2

(12) United States Patent
Whitaker

(10) Patent No.: US 9,955,824 B2
(45) Date of Patent: May 1, 2018

(54) SHOWER DOOR LEVELER

(71) Applicant: Thomas M. Whitaker, Stratford, CT (US)

(72) Inventor: Thomas M. Whitaker, Stratford, CT (US)

(73) Assignee: Mr. Shower Door, Inc., Stratford, CT (US)

( * ) Notice: Subject to any disclaimer, the term of this patent is extended or adjusted under 35 U.S.C. 154(b) by 96 days.

(21) Appl. No.: 14/844,950

(22) Filed: Sep. 3, 2015

(65) Prior Publication Data

US 2017/0065133 A1 Mar. 9, 2017

(51) Int. Cl.
*A47K 3/34* (2006.01)
*E05D 15/06* (2006.01)

(52) U.S. Cl.
CPC ..... *A47K 3/34* (2013.01); *E05D 15/0652* (2013.01)

(58) Field of Classification Search
CPC . A47K 3/24; A47K 3/362; A47K 3/34; A47K 3/283; A47K 3/284; E06B 1/70; E06B 7/14; E06B 7/145; E06B 3/4636
USPC ..... 49/467, 469, 471
See application file for complete search history.

(56) References Cited

U.S. PATENT DOCUMENTS 1,576,098 A * 3/1926 Deitz ..... E06B 3/4663 16/96 R
1,944,440 A * 1/1934 Lehman ..... A47K 3/36 4/607
2,911,654 A * 11/1959 Bruno ..... A47K 3/34 16/100
3,384,998 A * 5/1968 Abramson ..... A47K 3/34 16/90
3,475,866 A * 11/1969 Johansen ..... E06B 1/70 49/468
4,014,070 A * 3/1977 Rifkin ..... A47K 3/34 16/90
4,073,035 A * 2/1978 Baus ..... A47K 3/34 16/96 R
4,258,443 A * 3/1981 Baus ..... A47K 3/34 16/90
4,392,272 A * 7/1983 Finkel ..... A47K 3/34 16/95 R
4,922,661 A * 5/1990 Dallaire ..... E06B 3/4681 49/467
7,730,670 B2 6/2010 Whitaker

FOREIGN PATENT DOCUMENTS

GB 1304750 A * 1/1973 ..... A47K 3/34
GB 2097047 A * 10/1982 ..... A47K 3/36

* cited by examiner

*Primary Examiner* — Erin Deery
(74) *Attorney, Agent, or Firm* — St. Onge Steward Johnston & Reens, LLC

(57) ABSTRACT

A shower door assembly including at least one door panel having a bottom surface, a bottom frame member including a top portion and a bottom portion, the top portion including two grooves on a lower side thereof, the bottom portion including two sidewalls each having a top edge engaged in one of the two grooves, the door panel adjacent to and above the top portion of the bottom frame member, wherein the bottom surface of the at least one door panel is in a plane divergent to a plane of a bottom surface of the bottom frame member.

13 Claims, 6 Drawing Sheets

SHOWER DOOR LEVELER

FIELD OF THE INVENTION

The invention relates to shower door components and hardware, and more specifically to an improved track for shower doors adapted to accommodate sloped surfaces.

BACKGROUND OF THE INVENTION

Sliding shower doors are generally mounted with hardware that attaches shower door panels to the sides and threshold of the shower. As shown in commonly owned U.S. Pat. No. 7,730,670, a lower horizontal frame member may guide or attach the bottom or the shower door panels to the threshold.

It is common during the construction of a shower to slope the floor and, particularly with prefabricated basins, the threshold towards the drain of the shower to direct the runoff of water. While this is advantageous for water runoff, it creates difficulties when installing a shower door as the opening is not level. Especially with sliding shower doors, the shower door hardware must accommodate the slope to ensure that the door is level. Lower frame members must either be manufactured in a number of different fixed slopes or modified onsite to ensure that the door is level. Modifying the lower frame member onsite, such as by cutting, can lead to rough and unsightly edges that diminish the aesthetics of the shower door and create a potential hazard.

What is desired, therefore, is an improved shower door frame which is readily adaptable to different slopes.

SUMMARY OF THE INVENTION

Accordingly, it is an object of the present invention to provide a shower door frame that can be cut or otherwise modified to adjust to different slopes while maintaining a clean look and safe edges. It is a further object of the present invention to provide a shower door assembly incorporating such a shower door frame member.

These and other objects are achieved by providing a shower door attachment device, including an elongated rail including a bottom portion connected to a top portion, the bottom portion having first and second sidewalls extending along a length of the elongated rail, each of the first and second sidewalls having a top edge, the top portion including a lower side with two elongated grooves, extending along the length of the elongated rail, each of the grooves receiving and at least partially concealing one of the top edges of the first and second side walls. The length may correspond to a width of a shower door opening.

In some embodiments, the top edge and a bottom edge of each of the first and second sidewalls are divergent. In some embodiments, an upper surface of the top portion of the rail is sloped in a direction along the length with respect to a bottom surface of the bottom portion of the rail. The upper surface may also be sloped in a direction along a width of the rail.

Further provided is a shower door assembly including at least one door panel having a bottom surface, a bottom frame member including a top portion and a bottom portion, the top portion including two grooves on a lower side thereof, the bottom portion including two sidewalls each having a top edge engaged in one of the two grooves, the door panel adjacent to and above the top portion of the bottom frame member, wherein the bottom surface of the at least one door panel is in a plane divergent to a plane of a bottom surface of the bottom frame member.

In some embodiments, the assembly includes a top frame member above the door panel including at least one engagement device attached to the door panel. The assembly may also include two side frame members extending between the top frame member and the bottom frame member.

Other objects are achieved by providing a method of assembling a shower door attachment device, including the steps of providing an elongated bottom member having two sidewalls and a bottom wall therebetween, each of the two sidewalls having a top edge, providing an elongated top member, a lower side of the top member having two elongated channels, cutting along at least a portion of each of two sidewalls at an angle defining a cut top edge of each of the two sidewalls, and joining the bottom member and the top member by inserting each of the cut top edges into a corresponding one of the two channels.

The method may also include the step of determining an angle of a shower door threshold, wherein the angle defining the cut top edge of each of the two sidewalls corresponds to the angle of the shower door threshold. In some embodiments, the method includes the step of attaching an elongated guide to a top surface of the top member, the guide including at least one channel.

Other objects of the invention and its particular features and advantages will become more apparent from consideration of the following drawings and accompanying detailed description.

DETAILED DESCRIPTION OF THE INVENTION

Figure 1:
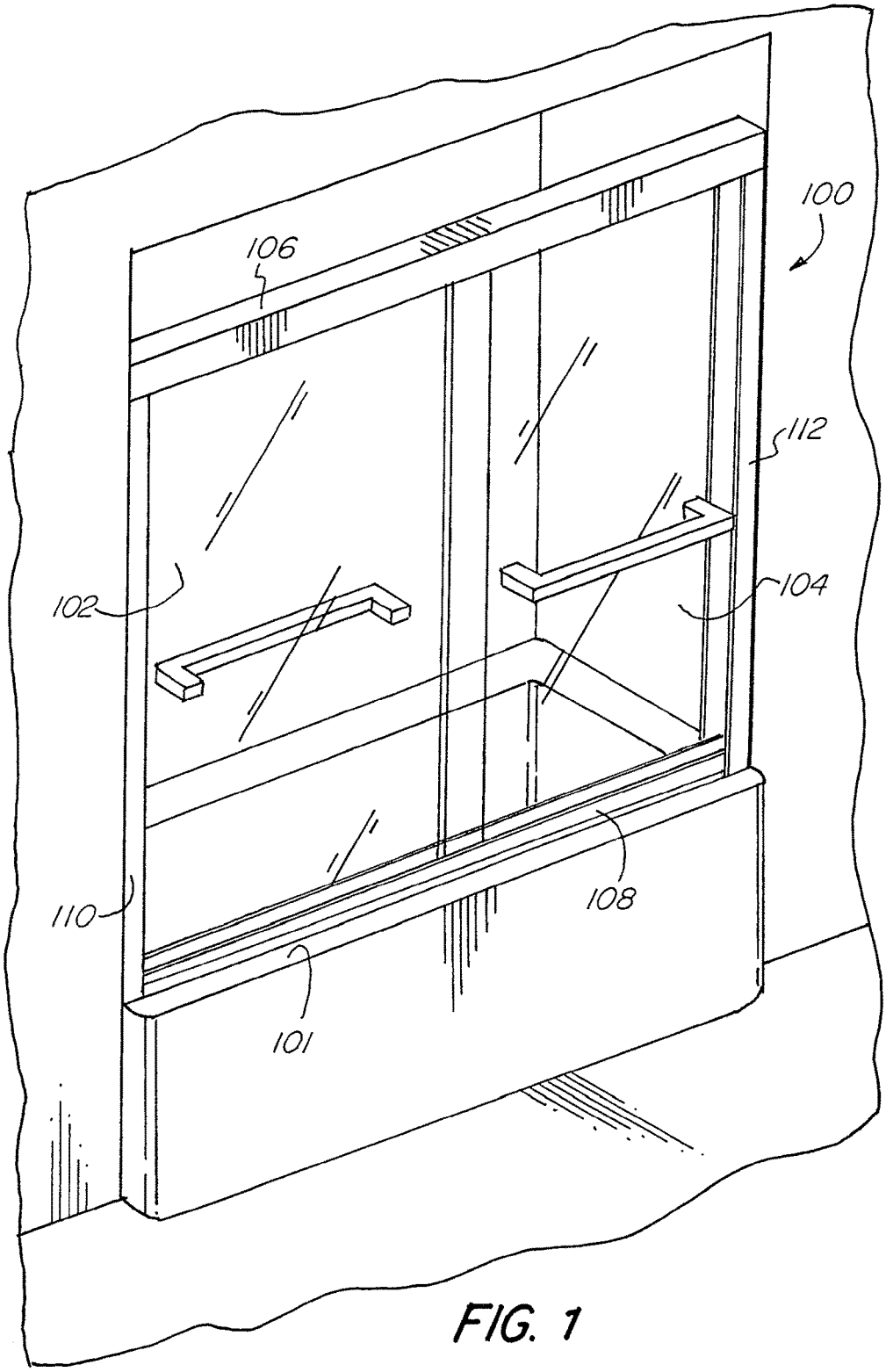
FIG. 1 shows a shower door assembly according to an exemplary embodiment of the present invention.

FIG. 1 illustrates a shower door assembly 100 according to an exemplary embodiment of the present invention. The shower door assembly 100 is installed in a shower and/or bath. The shower door assembly 100 includes one or more sliding glass panels 102/104, and a frame including an upper frame member or rail 106, a lower frame member or rail 108, and side frame members 110/112. The upper frame member 106 may include a track and engagement devices as illustrated and described in U.S. Pat. No. 7,730,670, incorporated herein by reference.

Figure 2:
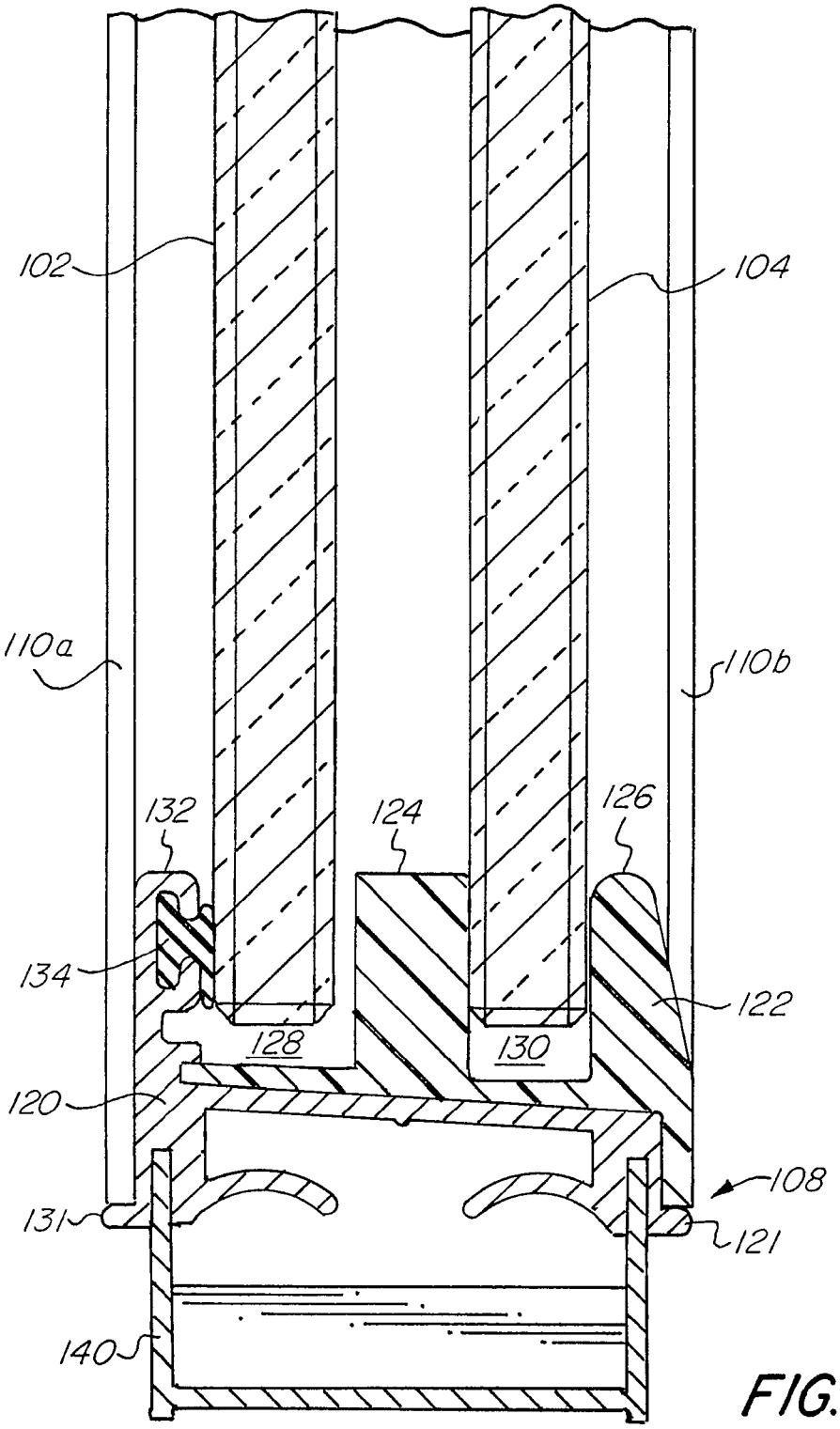
FIG. 2 is an end view of a shower door assembly according to an exemplary embodiment of the present invention.

FIG. 2 illustrates an end view of the shower door assembly 100. The lower frame member 108 includes a top portion or track 120 and a separate bottom portion or wedge 140. The wedge 140 is attached to a threshold 101 of the shower by screws, glue or adhesive. In the exemplary embodiment, the track 120 may include a guide 122 fixed to a top surface of the track 120 with projections 124/126 defining channels

128/130 to retain and guide the glass panels 102/104. The upper and lower frame members 106/108 are generally manufactured from extruded metal, while the guide 122 may be a metal or preferably a polymer. In some embodiments, the guide 122 is formed integrally with the track 120. The track 120 may also include a projection 132 including a rubber or polymer insert 134. In the exemplary embodiment, the track 120 further includes edges 121/131 extending from the front and back of the track 120 to support the side frame members 110*a*/110*b* and/or the guide 122. One skilled in the art will understand that these features of the track 120 are only exemplary and the present invention may be implemented with any type of top portion 120 (e.g., for sliding or swinging doors), with any type of guide, or with no guide.

Figure 3:
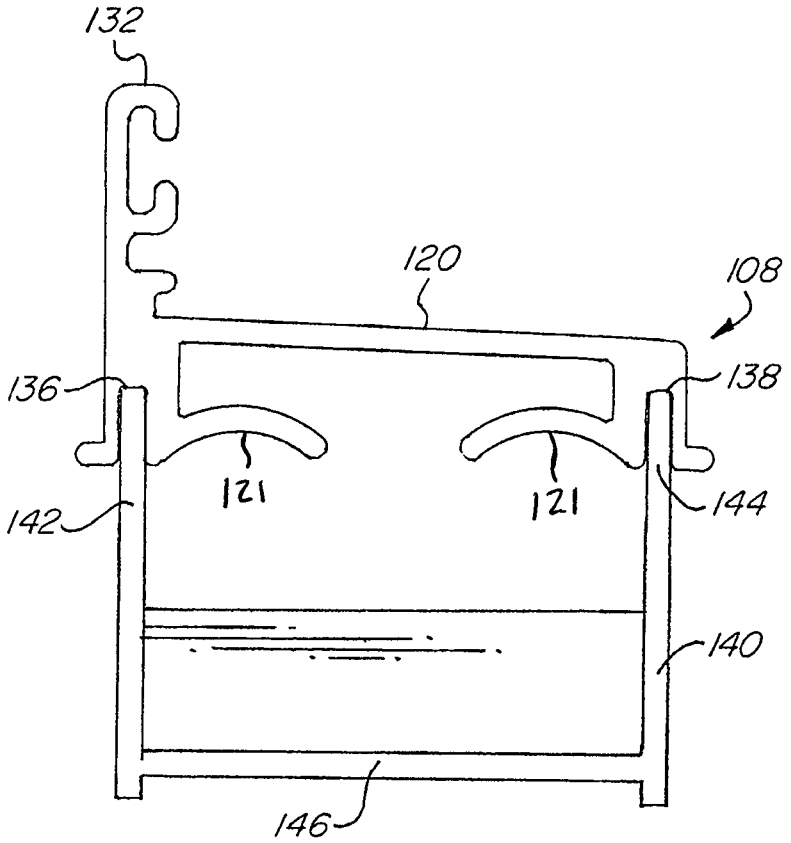
FIG. 3 is an end view of a frame member according to an exemplary embodiment of the present invention.

FIG. 3 further illustrates an end view of the lower frame member 108. The wedge 140 includes two upward extending sidewalls 142/144 and a bottom wall 146 therebetween. The track 120 of the lower frame member 108 includes downward extending front and back channels or grooves 136/138 (e.g., about 3/16 in. deep in the exemplary embodiment) along its outer edges which each receive one of the sidewalls 142/144. In particular, top edges of each of the sidewalls 142/144 engage into the channels 136/138 to conceal the top edges and create the assembled lower frame member 108. In the exemplary embodiment, the track 120 includes arced members 121 extending inward from inner sidewalls of the channels 136/138 for added structural support.

Figure 4B:
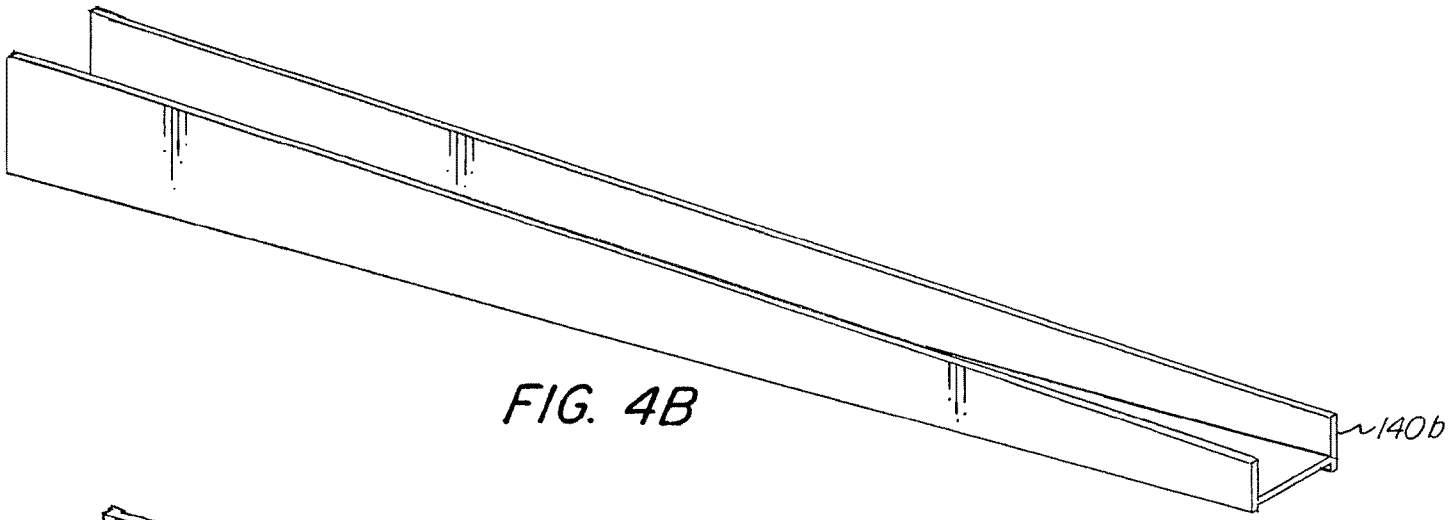
FIGS. 4A and 4B are perspective views of a lower portion of a frame member being cut to accommodate a slope.
Figure 4A:
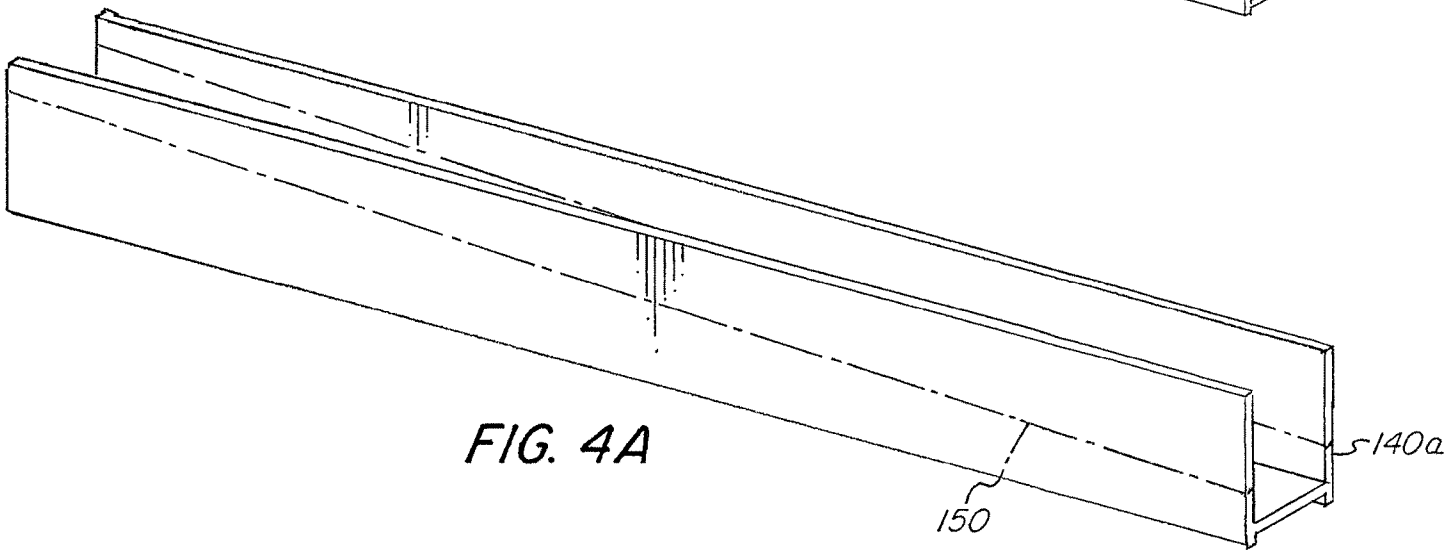

FIGS. 4A-4B show the wedge 140 and how it may be cut to accommodate sloping shower or bath entries. As shown in FIG. 4A, a wedge 140*a* is first manufactured (e.g., by extrusion) with top edges that are substantially parallel to bottom edges of the wedge 140. For a shower entry without any slope, the wedge 140 may be used as shown in FIG. 4A without further modification. However, if a slope is encountered, the sidewalls 142/144 of the wedge 140*a* may be cut in advance or onsite to accommodate the slope, e.g., along a cutline 150 determined based on the slope. The cutline 150 is generally not predetermined and the wedge 140 may be cut at any particular angle necessary to match the slope. An installer may measure or otherwise determine the slope of the shower threshold 101, mark a cutline on the wedge 140*a* if necessary, and cut the wedge 140*a* (e.g., using a table or hand saw) to have a slope corresponding to the threshold. For example, if the threshold 101 has a downward angle of 1.5 degrees, the wedge 140*a* may be cut with downward angle of 1.5 degrees in an opposite direction.

One skilled in the art will understand that the slope of cutline 150 is exaggerated in FIGS. 4A-4B for illustration purposes and, in most cases, would be slight. For example, in a lower frame member 108 having a length of fifty-nine and one-eight inches (59 1/8 in.), the cutline 150 may be approximately five-sixteenths of an inch (5/16 in.) from the top edge on one end and thirteen-sixteenths of an inch (13/16 in.) from the top edge on the opposite end. Cutting of the wedge 140*a* results in a tapered wedge 140*b* as shown in FIG. 4B.

Figure 5:
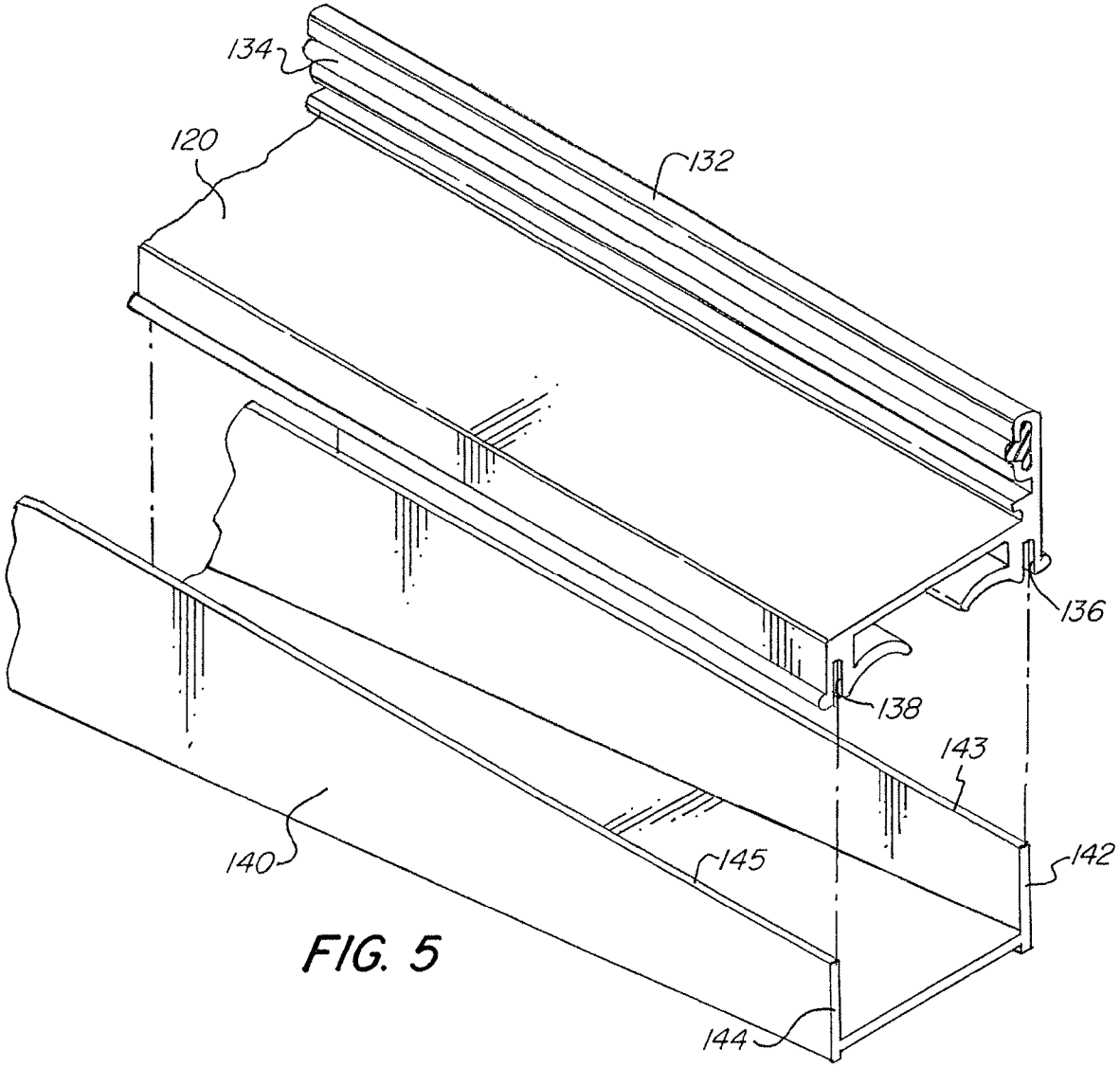
FIG. 5 illustrates the assembly of lower and upper portions of a frame member according to an exemplary embodiment of the present invention.
Figure 6:
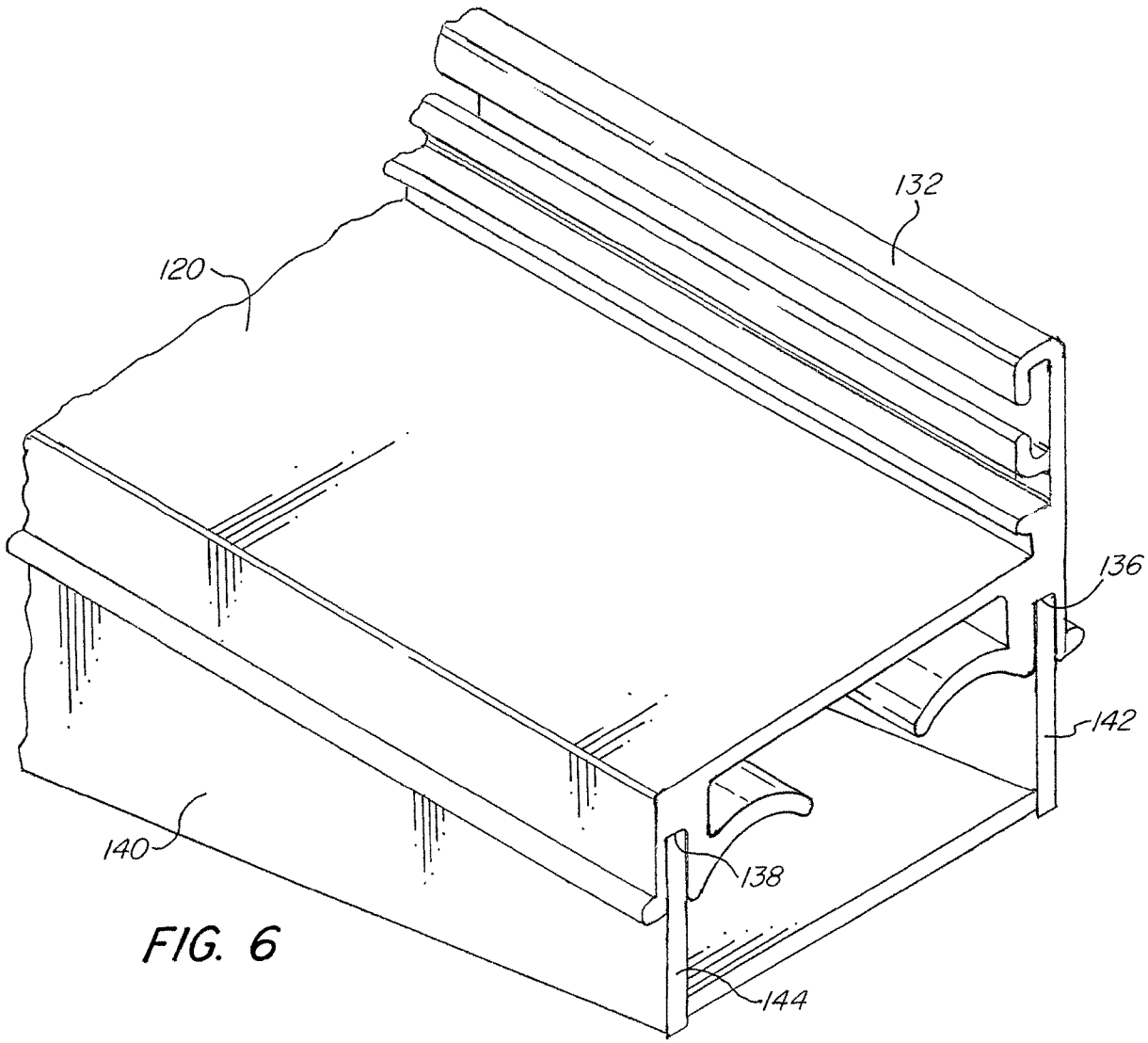
FIG. 6 is a perspective view of a frame member according to an exemplary embodiment of the present invention.

FIGS. 5 and 6 illustrate the assembly of the lower frame member 108 after the wedge 140 is cut. Top edges 143/145 of the sidewalls 142/144 are inserted into the grooves 136/138 along the length of the track 120. This arrangement is advantageous since the top edges 143/145, or at least portions thereof, will often be rough or unfinished after being cut. The grooves 136/138 conceal and eliminate any danger or unsightliness of the top edges 143/145. In some embodiments, the wedge 140 and track 120 may be secured together by mechanical means, adhesive, glue or bonding. In other embodiments, the wedge 140 and track 120 are held together by the side frame members 110/112. The resulting lower frame member 108 is tapered or sloped (in a direction along the length of the frame member 108) such that the bottom surface is in a divergent plane with respect to the top surface.

Although the invention has been described with reference to a particular arrangement of parts, features and the like, these are not intended to exhaust all possible arrangements or features, and indeed many modifications and variations will be ascertainable to those of skill in the art.

What is claimed is:

1. A shower door attachment device, comprising:

an elongated rail including a bottom portion connected to a top portion, said elongated rail having a length and a width;

said bottom portion having a bottom wall and first and second sidewalls extending up from the bottom wall parallel to one another along the length of said elongated rail, each of the first and second sidewalls having a top edge that is sloped along the length of said elongated rail such that a height of said bottom portion, from the top edges to the bottom wall, decreases along the length;

said top portion including a lower side with two elongated grooves, extending parallel to one another along the length of said elongated rail, each of the grooves receiving and at least partially concealing one of the sloped top edges of the first and second sidewalls along the length of said elongated rail;

wherein said elongated rail has a rail height, between a top surface of the top portion and the bottom wall of the bottom portion, that decreases along the length of said elongated rail.

2. The device according to claim 1, wherein the top surface of the top portion is sloped in a widthwise direction along the width of said elongated rail.

3. The device according to claim 1, further comprising a guide on the top surface of the top portion of said elongated rail including two channels extending along the length of said elongated rail.

4. The device according to claim 1, wherein said elongated rail is sized to fit a width of a shower opening.

5. The device according to claim 1, wherein the bottom wall of said bottom portion is perpendicular to each of the first and second sidewalls.

6. A shower door assembly, comprising:

at least one door panel having a flat bottom surface;

a bottom frame member with a length extending from a first distal end to a second distal end, said bottom frame member including a top portion and a bottom portion, the top portion including an upper side and lower side with two grooves on the lower side, the two grooves being parallel to one another, the bottom portion including two sidewalls parallel to one another along the length, of the two sidewalls, each of the two sidewalls having a top edge engaged in one of the two grooves, of the two sidewalls and each of the two sidewalls having a bottom edge resting on a sloped threshold;

said at least one door panel adjacent to and above the upper side of the top portion of said bottom frame member along the length;

wherein said bottom frame member has a height from the upper side to the bottom edge of one of the two sidewalls, the height decreasing along the length of said bottom frame member.

7. The shower door assembly according to claim 6, wherein, for each of the two sidewalls, the top edge and the bottom edge of each respective sidewall are divergent from each other.

8. The device according to claim 6, wherein the top edges of each of the two sidewalls are sloped.

9. The device according to claim 6, further comprising a guide on a top surface of the top portion including at least one channel for receiving said at least one door panel.

10. The device according to claim 6, further comprising a top frame member above said at least one door panel and including at least one engagement device attached to said at least one door panel.

11. The device according to claim 10, further comprising two side frame members extending between the top frame member and said bottom frame member.

12. The device according to claim 10, wherein the length of said bottom frame member is sized to fit a width of the sloped threshold.

13. A shower door attachment device, comprising:

an elongated rail including a bottom portion connected to a top portion, said elongated rail having a length and a width;

said bottom portion having a bottom wall and first and second vertical sidewalls extending up from the bottom wall along the length of said elongated rail, each of the first and second sidewalls having a top edge and a bottom edge;

the top portion including a lower side with two elongated grooves each defined by inner and outer surfaces, extending along the length of said elongated rail, each of the two elongated grooves receiving between its inner and outer surfaces, and at least partially concealing, one of the top edges of the first and second sidewalls along length of said elongated rail;

wherein the top edges of the first and second sidewalls slope along the length of said elongated rail such that said elongated rail decreases in height along the length.

* * * * *